United States Patent [19]

Friedman

[11] Patent Number: 4,566,964

[45] Date of Patent: Jan. 28, 1986

[54] METHOD OF RECOVERING HYDROCARBON FROM OIL SHALE

[75] Inventor: Robert H. Friedman, Houston, Tex.

[73] Assignee: Texaco Inc., White Plains, N.Y.

[21] Appl. No.: 751,343

[22] Filed: Jul. 2, 1985

[51] Int. Cl.[4] ..... C10G 1/04

[52] U.S. Cl. ..... 208/8 LE; 208/11 LE

[58] Field of Search ..... 208/8 LE, 11 LE

[56] References Cited

U.S. PATENT DOCUMENTS

| | | | |
|---|---|---|---|
| 2,487,788 | 11/1949 | Buchan | 208/11 LE |
| 2,596,793 | 5/1952 | Schabelitz | 208/11 LE |
| 2,966,450 | 12/1960 | Kimberlin et al. | 208/11 LE |
| 3,527,692 | 9/1970 | Titus | 208/11 LE |
| 3,697,412 | 10/1972 | Brimhall | 208/11 LE |
| 4,088,562 | 5/1978 | O'Ffill | 208/8 LE |
| 4,428,821 | 1/1984 | Bajet | 208/8 LE |
| 4,533,460 | 8/1985 | Ho | 208/11 LE |

*Primary Examiner*—John Doll
*Assistant Examiner*—A. Pal
*Attorney, Agent, or Firm*—Jack H. Park; Kenneth R. Priem

[57] ABSTRACT

Hydrocarbons may be recovered from crushed and ground oil shale by contacting the oil shale material with a free oxygen containing gas such as air in a fluid environment at a temperature range from 30° to 43° C. to remove organic fragments from the polymeric kerogen component of oil shale by oxidative scissions. The oxidation is conducted using a liquid phase solvent for the organic fractions removed from the kerogen. Preferred solvents are naphthalene, tetralin and phenanthracene. The solvent-organic fraction solution is then separated into solvent and organic fraction by sublimation with the solvent being recycled. The residual solids comprising oil shale material and unoxidized kerogen is then subjected to a bake-off to recover additional organic material from the kerogen. In addition to recovering a portion of the organic content from the kerogen, the oxidative scission reaction increases the susceptability of the kerogen to recovery by pyrolysis under milder conditions than the unoxidized oil shale material. The pyrolysis is conducted at a temperature from 400° F. to 750° F. for a time period from 0 to 2 hours.

23 Claims, 1 Drawing Figure

PROCESS FOR RECOVERING HYDROCARBONS FROM OIL SHALE

METHOD OF RECOVERING HYDROCARBON FROM OIL SHALE

FIELD OF THE INVENTION

This invention concerns a new and novel method for recovering hydrocarbon materials from oil shale. More specifically, this invention is concerned with a method for recovering hydrocarbon from oil shale by means other than retorting. Still more specifically, this invention is concerned with a method for recovering hydrocarbon from oil shale material which is mined and crushed and then subjected to a chemical oxidation to remove at least a portion of the hydrocarbon material from the oil shale.

BACKGROUND

Throughout the world there are vast reserves of hydrocarbons in the form of oil shales. Oil shales are sedimentary inorganic materials that contain appreciable organic material in the form of high molecular weight polymers. The inorganic portion of the oil shale is a marlstone-type sedimentary rock. Most of the organic material is present as kerogen, a solid, high molecular weight three dimensional polymer which is insoluble in conventional organic solvents. Usually the naturally-occurring oil shales contain a small amount of a benzene-soluble organic material which is referred to as bitumen.

The most extensive oil shale deposits in the United States are the Devonian-Mississippian shales. The Green River formation of Colorado, Utah and Wyoming is a particularly rich deposit, and includes an area in excess of 16,000 square miles. The in-place reserves of the Green River formation alone exceed 3 trillion barrels. The Piceance Basin of Colorado represents nearly 85 percent of the Green River reserves.

A typical Green River Oil Shale is comprised of approximately 85 wt. percent mineral (inorganic) components, of which the carbonates are the predominate species, and lesser amounts of feldspars, quartz and clays also being present. The kerogen component represents essentially all of the organic material, and the elemental analysis is approximately 78% carbon, 10% hydrogen, 2% nitrogen, 1% sulfur and 9% oxygen.

Most of the methods for recovering hydrocarbon or organic material from oil shale materials involve mining the oil shale material, crushing it, and subjecting the crushed oil shale materials to thermal decomposition. The thermal decomposition of oil shale, i.e. pyrolysis or retorting, yields liquid, gases and solid (coke) products. The relative amounts of oil, gas and coke produced are controlled primarily by varying the parameters of temperature and time during the course of retorting the oil shale. Modern oil shale retorting processes operate at about 480° C., (896° F.) in order to maximize the yield of liquid hydrocarbon products. It has been reported in the literature that oil yield decreases and the retort gas increases with increased retorting temperature. It has also been reported that the aromatic content of the synthetic crude oil produced in retorting of oil shale increases with increased temperature.

Several major problems remain unsolved in the commercialization of the processes for recovering hydrocarbon from oil shale by retorting. A substantial amount of the hydrocarbon component of the oil shale is consumed by combustion to generate the temperatures needed for the pyrolysis reaction. The synthetic crude produced is very high in olefins and low in saturates and aromatics, and so a substantial amount of hydrogen must be added to produce a good quality crude suitable for conventional refining. The hydrocarbon fraction which is produced in the gaseous state in the retorting process is greatly diluted by carbon dioxide resulting not only from the combustion of hydrocarbon portions of the oil shale, but also from thermal decomposition of the carbonate mineral fraction of the oil shale. Since dolomite and calcite are stable at temperatures far above the normal retorting temperatures, most of this carbon dioxide is derived from decomposition of dawsonite and nahcolite.

The state of the art retorting method only recovers about 56% of the kerogen as a useful product. Because of this, as well as the other problems discussed above, there is essentially no commercial production of synthetic crude oil from oil shale materials in the United States at the present time despite the enormous reserves represented by the oil shale deposits. It can be seen from the foregoing discussion that there is a substantial, unfulfilled need for a new process for recovering useful hydrocarbon products from oil shale by a process which reduces the cost for recovering the oil, or increases the percent of kerogen converted to useful product, or preferably both.

SUMMARY OF INVENTION

Briefly the process of my invention involves subjecting oil shale materials which have been removed from their original formation, crushed and ground to a suitable fineness, to a chemical oxidation by exposing the ground oil shale material to an oxidizing fluid environment comprising a heated liquid solvent for the first stage extracted material plus a free oxygen-containing gas. More specifically, the ground oil shale material is first exposed to a reaction environment in which it is dispersed, comprising a solvent for the first stage extracted product, preferably naphthalene, tetralin or phenanthrecene saturated with a free oxygen-containing gas such as air, at a temperature from 60° to 120° C. and preferably 70° to 100° C. Oxidation scission of the kerogen removes a portion of the kerogen from the ground oil shale solids, and also modifies the residual kerogen so as to make it more susceptible to subsequent heat treatment. In a preferred embodiment, the residual solid mineral and unreacted kerogen are then subjected to heat treatment at a temperature from 315° C. to 427° C. and preferably 371° C. to 399° C. in order to separate the remaining kerogen from the oil shale solids and convert the kerogen to useful, lower molecular weight organic materials. When employing certain of the preferred embodiment of the process of my invention, as much as 93% of the total organic carbon present in the raw oil shale material is recovered, compared to about 56% for conventional surface retorting methods, which represents a 62% increase in recovery.

BRIEF DESCRIPTION OF THE DRAWING

The attached drawing illustrates a preferred embodiment of the process of my invention whereby oil shale materials are mined, crushed, subjected to oxidative scission which recover hydrocarbon from kerogen after which the residual kerogen is removed by heat treatment at reduced temperatures over that required for retorting.

DETAILED DESCRIPTION OF THE PREFERRED EMBODIMENTS

Figure 1:
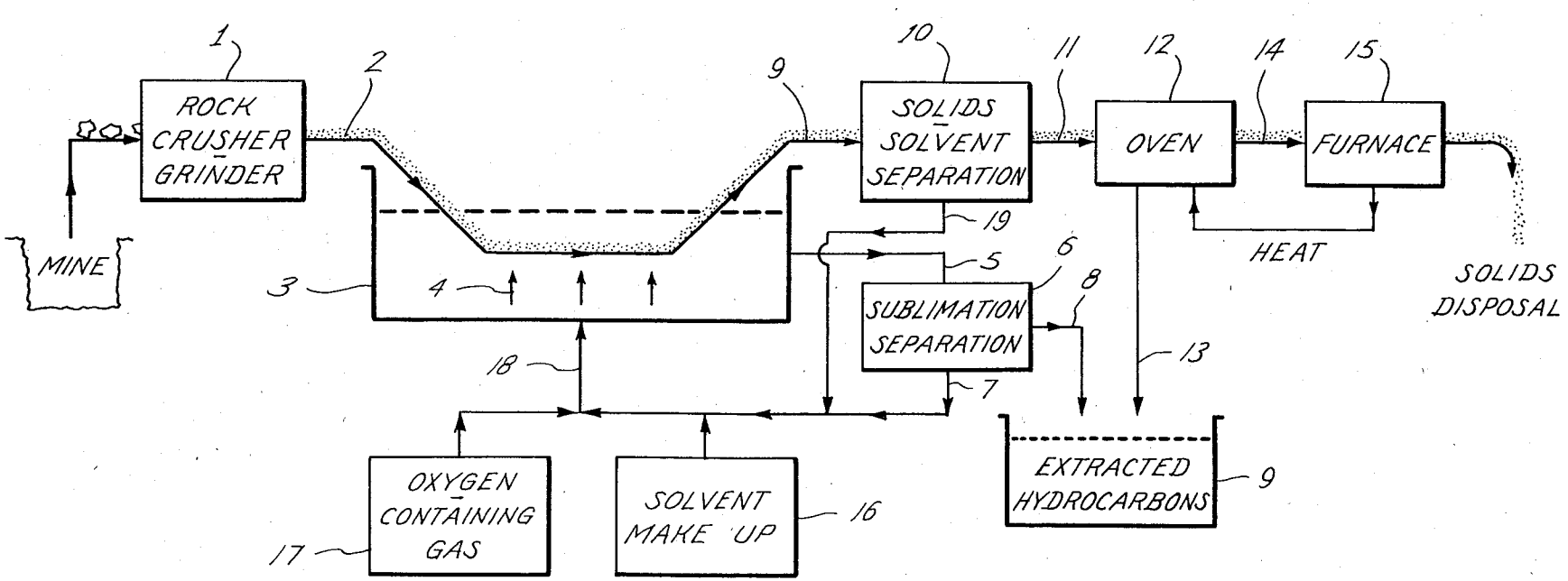

The objective of the research which lead to the discovery of the method that constitutes my invention was the development of a process for recovering usable products from oil shale, which utilized the minimum energy and water. The reduction in energy was desirable in order to improve the economics of the process as compared to state-of-the-art surface retorting techniques, and the reason for developing a system which requires a minimum amount of water was the fact that water is in very short supply in the areas where the largest and richest oil shale deposits are located.

I have discovered that kerogen, which is a complex, three dimensional polymer, can be at least partially depolymerized by oxidating scission. Once small organic molecules are produced, they can then be dissolved in a hydrocarbon solvent, even though the kerogen is insoluble in the solvent.

The following description of the experimental work which lead to and supports my discovery will aid substantially in understanding the process of my invention.

A quantity of oil shale was obtained from the area near Anvil Point, Colo., and the same material was used in all of the experimental results reported hereinafter below. This oil shale sample was rated at 27 gal/ton by Fisher Assay. My analysis indicated that it had a total organic carbon (TOC) of 15%, which as hydrocarbon would represent about 17% by weight at the usual hydrogen to carbon ratio of 1.64. The total weight of kerogen per ton of this particular oil shale sample is about 340 pounds. Fisher Assay ordinarily would indicate that the possible yield is about 210 pounds, which is only 62% of the hydrocarbon present in the sample. It is important in comparing my data with that reported in the literature to distinguish between recovery of total hydrocarbon and Fisher Assay recovery figures, which differ from one another by a ratio of 1 to 0.62. A method reported in the literature and described as the Paraho method recovered 92% of Fisher Assay, which is 56% ($0.92\times0.62$) of the total kerogen present in the sample. The work reported herein will utilize the percent of total organic carbon recovered under the discussion of yields, since it represents a more precise, accurate description of the results obtained in the processes being evaluated.

In the first series of tests, the experimental work was performed to determine whether simple oxidation of the kerogen in a ground oil shale material could be employed to recover any significant amount of hydrocarbon product. To this end, a sample of the above-described oil shale was ground and extracted with pyridine to recover the small amount of bitumen normally present in oil shale. The extracted sample (the solid material remaining after the pyridine extraction) was then placed in a container and covered with water. Air and steam were bubbled through the slurry for several hours. The rock was then extracted again by pyridine. Additional hydrocarbon materials were recovered with pyridine extraction over than which was possible prior to the reaction of the material with air and steam. Repetition of the oxidation followed by pyridine extraction cycles through several cycles resulted in an increase in yield of recovered hydrocarbon materials each time. This suggested that a surface phenomenon was involved.

The next series of tests were intended to determine whether it was possible to combine the oxidative scission and the solvent extraction in a single step. To do this it was necessary to use a solvent which did not oxidize readily. It should be understood that by use of the term "solvent", it is meant a fluid which is a solvent for the product derived from the kerogen as a result of the oxidative scission, but it is not a solvent for unreacted kerogen. The desired properties of a preferred solvent for use in my process are that it be inexpensive, relatively immune to the mild oxidation conditions employed in the first stage of my process, that it be liquid at a relatively low temperature, and that it be easily sublimed at atmospheric pressure so separation of the extract from the extracted hydrocarbon material can be accomplished under relatively mild reaction conditions.

The preferred embodiment of my inventions are best understood by careful review of the examples given below.

EXAMPLE 1

Oxidative Scission with Air in Naphthalene

A 100 gram sample of ground oil shale (approx. 300 mesh) was placed in molten naphthalene which was at a temperature of 100° C. Air was bubbled through the system at a rate of 2.65 ml/sec, for eight hours, with frequent stirring to promote uniformity of oxidation. After the air oxidation was completed, the excess naphthalene and the naphthalene soluble material were decanted off and set aside for subsequent treatment and weight determination. The oxidized oil shale was then cleaned with xylene and acetone to remove residual naphthalene. Samples of the raw oil shale and the oxidized oil shale were analyzed for total organic carbon on a $CO_2$ Coulometer. The total organic carbon of the raw oil shale was found to be 15.1%. The TOC of the oxidized material was 10.6%. The naphthalene was then sublimed off the naphthalene-solubles and the residue's weight was determined to be 4.8 grams. Thus it can be seen that this chemical oxidation of the ground oil shale material using air and naphthalene recovered 29.8% of the total organic carbon present in the material. Although this is less than many retorting methods recovered, the cost per unit weight of recovered material is extremely low as compared to retorting techniques.

The next experiment was performed to determine whether a reduction in pH would increase the effectiveness of the Oxidative Scission step.

EXAMPLE 2

Oxidative Scission with Air in Naphthalene at pH 4

A 100 gram sample of ground oil shale was treated in the same manner as described in Example 1, except that sufficient acetic acid was added at the beginning of the experiment to reduce the pH of the system from 7 to 4. This was done to increase the oxidative potential. The procedure was otherwise essentially identical to that described in Example 1, and it was determined that the final TOC was 10.12%, indicating that the % of organic carbon recovered had increased from 29.8% to 32.98. This represents a small but significant improvement in the effectiveness of the oxidative scission step, accomplished by reducing the pH to a value of 4. Attempts to increase the oxidation effectiveness by reducing the pH to a value of less than 4 was ineffective, since the mineral decomposition at a lower pH tends to consume excessive quantities of acid and interferes with the progress of the reaction.

The next example illustrates the effectiveness of material to reduce the oxidation potential of the oxidation reaction mixture would increase the effective yield.

EXAMPLE 3

Addition of $KI:I_2$ to the Oxidative Scission Process

A 100 gram sample of oil shale was treated in precisely the same manner as in Example 2, except that 1 gram of an equal molar mixture of potassium iodide and iodine were added to the reaction mixture. It was hoped that this modification would produce a greater degree of homogeneity in the oxidation. Analysis of the results indicated the TOC of the residual solids was 9.16%, indicating that indeed the addition of potassium iodide and iodine to the reaction mixture did increase the percent of hydrocarbon removed from the oil shale material from 32.98 to 39.34 percent.

EXAMPLE 4

Oxidative Scission with Air in Tetralin

A 100 gram sample of oil shale was air oxidized in essentially in the same manner as is described for Example 2 with the exception that tetralin was used as a solvent instead of naphthalene. It was hoped that the hydrogen-donating ability of tetralin would increase the amount of hydrocarbon recovered in the first stage process. Analysis of the residual solids indicated the TOC was 9.39%, again representing an improvement over the results of Example 2. A subsequent run in which molecular hydrogen was added did not improve hydrocarbon recovery.

EXAMPLE 5

Oxidative Scission with Air and Phosphate in Naphthalene

Another 100 gram sample of oil shale material was air oxidized in a process identical to that described in Example 2, except that 10 grams of sodium phosphate was added to the reaction mixture. It was hoped that the sodium phosphate would bind with calcium in the oil shale and thereby increase the physical access to the kerogen. Analysis of the results indicated total organic content of the residual solids was 9.23%, indicating recovery increase from 32.98 to 38.87%.

EXAMPLE 6

Oxidative Scission with Air in Phenanthrecene at 100° C.

Another 100 gram sample of oil shale material was air oxidized in essentially the same method as described for Example 2, except phenanthracene was utilized as the solvent rather than naphthalene. It was hoped that by utilizing a solvent with a higher boiling point, the effect of increasing temperature could be determined. Recovery at 100° C. in pH4 was 36.69%, representing a slight improvement over the 32.98% obtained in Example 2 at the same temperature but using naphthalene.

EXAMPLE 7

Oxidative Scission with Air in Phenanthrencene at 200° C.

Another 100 gram sample of oil shale was treated as described in Example 6, except that the temperature was increased to 200° C. to measure the effect of temperature on the recovery obtained by the first stage oxidative scission. It was determined that the total oil recovery of the residual solids was 9.1%, indicating total recovery was 39.74%, a slight improvement over the 36.69% obtained with the same reaction condition but at 100° C.

EXAMPLE 8

Oxidative Scission with Air in Phenanthrencene at 300° C.

Another 100 gram sample of oil shale material was treated in the same manner as that described for Example 6, except the reaction to the temperature was raised to 300° C. The final TOC of the residual solids was 8.95%, indicating that the total recovery at this elevated temperature was 40.73%, indicating the improvement in recovery effectiveness from 200° to 300° was somewhat minor.

EXAMPLE 9

Oxidative Scission with Air in Naphthanlen Followed by a 400° F. RAPID HEATING A 100 gram sample of oil shale was oxidized as described in Example 1. The oxidized oil shale was then placed in a 400° F. (190° C.) preheated open container and heated for one hour. This was done in an attempt to decarboxylate the oil shale. The sample was then analyzed for TOC, which was determined to be 10.01%. This indicates that very little additional hydrocarbon material was obtained over than obtained in Example 1 by the 400° F. bake-off. The material which had been heated at 400° F. was then subjected to a second stage oxidated scission treatment similar to that described for Example 1 and a second bake-off, and no additional yield of hydrocarbon was obtained. This clearly indicated that the 400° rapid heating did not cause pyrolysis of the residual kerogen nor did it sufficiently decarboxylate the residual portion of the kerogen from the first stage oxidative scission treatment to permit additional recovery in a subsequent oxidative scission.

EXAMPLE 10

Oxidative Scission with Air in Naphthalene Followed by a 500° F. Rapid Heating A 100 gram sample of oil shale was treated as described in Experiment 9, except the bake-off was performed at 500° F. (245.8° C.). It was hoped that the increase in temperature in the second stage heating treatment would increase the yield. Analysis of the residual solid materials indicated the TOC was about 6.16%, indicating that the recovery increased from 33% in Example 9 to 59% in Example 10. This is a very substantial increase in the amount of recovered hydrocarbons for only a 100° F. increase in temperature.

EXAMPLE 11

Oxidative Scission with Air in Naphthalene Followed by a 600° F. Rapid Heating A 100 gram sample of oil shale was treated as described in Experiment 9, except the preheated container temperature was 600° F. (301.3° C.). The final TOC of the residual solids was 2.28%, indicating that the 600° F. bake-off second stage treatment raised the total recovery to 84.9% of the hydrocarbon material originally present. This is a significant improvement over the 59.21% observed for the 500° F. bake-off of Experiment 10.

EXAMPLE 12

Oxidative Scission with Air in Naphthalene Followed by a 750° F. RAPID HEATING Another 100 gram sample of oil shale was treated as described in Experiment 9, except the preheated container's temperature was 750° F. (385.7° C.). The TOC of the residual solids was measured and found to be 0.44%, indicating that the total oil recovery had increased to 97.09%. Again, this represents a substantial improvement over the 84.9% obtained in Example 11 at a 600° F. bake-off temperature.

EXAMPLE 13

750° F. Bake-off without Prior Oxidative Scission

For purpose of comparison, a 100 gram sample of oil shale which had not been first subjected to the chemical scission of the first stage treatment, was placed in a container preheated to 750° F. and allowed to bake-off for one hour in the same manner as the second stage of Experiment 12. The results, recorded as Example 13 in Table I below, indicate that only 75% of the material originally present in the sample was recovered. Clearly, the chemical pretreatment for Example 12 resulted in increasing the yield over Example 13, in which no oxidative pretreatment step was utilized, from 75.17 to 97.09%, a very significant 29.45% improvement.

EXAMPLE 14

Oxidative Scission with Air in Tetralin plus Phosphate

A 100 gram sample of oil shale was treated as described in Experiment 4, with the addition of 10 grams of sodium phosphate. This was done to determine if the gains seen when using tetralin instead of naphthalene (Example 4 vs. Example 1), and the gains seen when utilizing phosphate over a similar experiment without phosphate (Example 5 vs. Example 2), were additive. The TOC of the residual solids was determined to be 9.27%, indicating the yield increases were not additive.

EXAMPLES 15 and 16

Oxidative Scission with Air, $KI/I_2$, and Phosphate in Naphthalene

A 100 gram sample of oil shale was treated as described in Experiment 3 with the addition of 10 grams of sodium phosphate to determine if the yields observed in adding phosphate to naphthalene and the yield improvement with adding potassium iodide-iodine mixture to the naphthalene air reaction conditions were additive. The TOC of the residual solids was measured and found to be 9.17%. A subsequent solvent change to tetralin did not increase the yield as is reported in the table for Example 16. These experiments indicate that the yields are not additive.

The results of Examples 1–16 described above are summarized in Table I below:

TABLE 1

RESULTS OF VARIOUS OXIDATION METHODS

| EXAMPLE NO. | METHOD | TOC | % Removed |
|---|---|---|---|
| — | Untreated Tar Sand Material | 15.1 | — |
| 1 | Air/Naphthalene (100° C. pH 7) | 10.6 | 29.80 |
| 2 | Air/Naphthalene (100° C. pH 4) | 10.12 | 32.98 |

TABLE 1-continued

RESULTS OF VARIOUS OXIDATION METHODS

| EXAMPLE NO. | METHOD | TOC | % Removed |
|---|---|---|---|
| 3 | Air/Naphthalene (100° C. pH 4) $KI/I_2$ | 9.16 | 39.34 |
| 4 | Air/Tetralin (100° C. pH 4) | 9.39 | 37.81 |
| 5 | Air/Naphthalene (100° C. pH 4) Phosphate | 9.23 | 38.87 |
| 6 | Air/Phenanthracene (100° C. pH 4) | 9.56 | 36.69 |
| 7 | Air/Phenanthracene (200° C.) | 9.10 | 39.74 |
| 8 | Air/Phenanthracene (300° C.) | 8.95 | 40.73 |
| 9 | Air/Phenanthracene (100° C.) 400 ° F. bake-off | 10.01 | 33.71 |
| 10 | Air/Phenanthracene (100° C.) 500 ° F. bake-off | 6.16 | 59.21 |
| 11 | Air/Phenanthracene (100° C.) 600° F. bake-off | 2.28 | 84.90 |
| 12 | Air/Phenanthracene (100° C.) 750° F. bake-off | .44 | 97.09 |
| 13 | No Oxidation/750° F. Bake-off | 3.75 | 75.17 |
| 14 | Air/Tetralin (100° C. pH 4) Phosphate | 9.27 | 38.61 |
| 15 | Air/Naphthalene (100° C. pH 4) Phosphate $KI/I_2$ | 9.17 | 39.27 |
| 16 | Air/Tetralin (100° C. pH 4) Phosphate $KI/I_2$ | 9.20 | 39.07 |

Another experiment was conducted to determine the nature of the products obtained in the optimum embodiment of the process of my invention. For this purpose, an experiment was conducted which in effect was a repeat of Example 12, in which the oil shale material was first subjected to the chemical oxidation step utilizing air in naphthalene, followed by a 750° F. rapid heating stage to bake-off the residual materials. The laboratory equipment was modified to permit taking the bake-off effluent down in temperatures in discreet increments in order to accomplish a crude separation of the produced effluent. The fractionation temperatures chosen were 500° F., 300° F. and 32° F. The volume of effluent in the gas phase, i.e. the 32° F. portion of the baked-off material was also measured.

A 40 gram sample of oxidized oil shale was loaded into a high pressure container set in a kiln which was initially at room temperature. The outlet of the container ran to a trapping vessel in an adjacent oven, and suitable insulation was placed over the connecting tubing to essentially eliminate the effect of temperature losses. Similar arrangements ran the effluent from the first oven collection point to a trapping vessel in a second oven. The outlet of the second oven then connected to a flask immersed in an ice bath. All portions of the equipment were weighed before being connected and all threads were coated with high temperature pipe dope. The two ovens contained in the collection vessels were heated to their respective run temperatures (300° F. and 500° F.). The kiln was then turned on to full power and allowed to reach 800° F. The temperature was monitored continually, and once the temperature reached 750° F. the temperature was held between 750° and 800° F. for two hours. The two ovens containing collection devices were then turned off, the 300° oven first followed by the 500° F. oven, allowing the ovens to cool before the kiln, so a slight vacuum would be created by differential cooling rates thereby drawing any remaining effluent in the kiln reaction vessel into the collection vessels. The kiln was then shut down and after all of the apparatus had reached room temperature, the apparatus was dissembled and each section was weighed and yield weights recorded. The total yield was 4.32 grams. The distribution of material was 0.4 grams in the tubing, 0.59 grams in the 32° F. collection flask, 0.59 grams in the 300° F. collection vessel and 2.74 in the 500° F. collection vessel. A total of 760 ml was measured on the wet gas meter. Once air expansion had been taken into account, the gas produced was calculated to be 4.6% of the total kerogen. Final TOC was measured on the remaining rock and found to be 0.39 or less than 3% of the original organic carbon content of the oil shale sample. Total utilizable yield including the oxidation extraction yield was in excess of 90%. The data are listed in Table II below:

TABLE II

DISTRIBUTION OF TOTAL ORGANIC CARBON

| Recovery Stage | % Organic Carbon |
|---|---|
| Oxidation/Extraction | 29.8 |
| Bake-Off Condensate | |
| 500° F. | 38.4 |
| 300° F. | 8.3 |
| 32° F. | 8.2 |
| Tubing | 5.6 |
| Utilizable Yield Subtotal | 90.3 |
| Gas | 4.6 |
| Residual | 2.7 |
| Total | 97.6 |

The above data show a total organic carbon less than 100%. Several factors might account for this result, the most likely being the number resenting the organic carbon content of the gas phase. The percent of organic carbon in the total gas phase evolve from the experiment was calculated by subtracting out the volume increase due to expansion caused by heating from the overall gas volume reading. The calculation assumed ideal gas law behavior, whereas the gases involved are not ideal. Also, no corrections were made for water saturation or air expansion from the tubing. Another possible source of error involved the heavy apparatus utilized, which was necessary because of the high temperature and pressures involved. Finally, the numbers did not take into account any weight increase due to additional oxygen that may have been incorporated during the procedure. Nevertheless, the unnormalized figures are very encouraging, indicating a total utilizable yield of 90% with only 4.6% gas and 2.7% residual.

DESCRIPTION OF A PREFERRED PROCESS

For purposes of additional disclosure including a disclosure of the preferred embodiment, the following is a description of one method for applying the process of my invention. The understanding of this embodiment will be aided by reference to the attached drawing, in which oil shale material is dug from a mine and conveyed to a rock crusher 1 in which the rock is crushed and ground to a suitable size. The mesh of the grinding of the product exiting from the grinder is to a large extent determined by the particular sample being utilized, but is ordinarily finer than 100 and preferably finer than 300 mesh. The crushed and ground rock will then be conveyed via a suitable conveyor 2 into a vessel 3 in which a solvent saturated with air is continually moving. Ideally, the direction of flow 4 of the air saturated solvent is at a right angle to the direction of movement of the rock being conveyed through the reaction chamber to optimize contact between solvent and tar sand material. By adjusting the speed of the conveyor through reaction vessel 3, and the length of the portion of the conveyor which is immersed in the air-saturated solvent bath, the dwell time of the crushed oil shale material may be controlled to the desired level. It is preferred that the dwell time of the crushed oil shale material in the air-saturated solvent mixture be from 1 to 6 and preferably from 2 to 4 hours. The temperature of the solvent-air mixture should be held above the melting point and below the boiling point of the solvent being employed. Ordinarily this is in the range from 80° to 150° F. and preferably from 90° to 110° F. The solvent utilized in this process will be any material which is an effective solvent for the low molecular weight fragments removed from the kerogen portion of the oil shale material by oxygen scission. Furthermore, the solvent must be liquid and a relative low temperature range, ideally 80° to 150° F. and preferably 90° to 100° F. It preferably should sublime from a mixture of solvent and extracted low molecular weight fragments removed from the kerogen at atmospheric pressure at a temperature of from 20° to 200° F. and preferably from 90° to 100° F. Preferred solvents are naphthalene, tetralin and phenanthracene. Any free oxygen containing gas can be utilized, but because of cost and availability, air is the gas of choice. Some improvement may be realized if the oxygen content of the air is increased by blending essentially pure oxygen with air, but in many applications simply saturating the solvent passing through the ground tar sand material in reaction vessel 3 with air is sufficient to accomplish the desired first step oxidative scission of the kerogen portion of the oil shale material.

The solution of low molecular weight fractions of kerogen, i.e. the extracted hydrocarbon produced in the oxidative scission step are withdrawn from container 3 via line 5 and transported to separation vessel 6, where the mixture of solvent and extracted hydrocarbon are separated by sublimation, with the solvent being recycled via line 7 back to the separation vessel 3, and the extracted hydrocarbon being transported via line 8 to a collection vessel 9. The temperature of the sublimation separation is in the range of from 90° to 120° F., depending on the solvent being utilized.

The residual solid material, i.e. the crushed oil shale material including the rock and the residual, unoxidized kerogen is transported further along conveyor 9 to a relatively low temperature separation vessel 10, which will be heated just enough to remove the solvent, said solvent being transported via line 19 back to join line 7, where it reenters the oxidative scission reaction vessel 3. The rock containing the unseparated kerogen and a small amount of unrecovered solvent is transported along conveyor 11 into a high temperature oven 12, where the rock is quickly heated to a temperature up to 750° F. This pyrolyzes and/or separates residual kerogen from the rock. Fluidized kerogen or pyrolysis products therefrom are transported via line 13 into the extracted hydrocarbon collection vessel 9. Hot rock from the bake-off separation stage 12 which may contain some residual kerogen and/or coke from the bake-off step can be transported via line 14 to furnace 15, where the residual hydrocarbon is burned to supply the heat necessary to operate the oven 12 as well as other separation units. Spent rock is then conveyed to a disposal site.

It can be seen that solvent from the sublimation separation stage 6 is mixed with solvent removed from the solid material in stage 10, and mixed with additional solvent make-up 16 to the extent necessary to maintain the solvent inventory at the desired level. The solvent is saturated with the free oxygen containing gas from supply 17, and injected into reaction vessel 3 via line 18.

In an alternative embodiment of my invention, the bake-off step in stage 12 is operated at the upper end of the recommended range, i.e. about 750° F., and the effluent is sent to an oven operating at an intermediate temperature, say 600° F. The material which condenses in the second oven is a relatively high molecular weight material which can be used as a fuel for the ovens. Spent rock will be transported to the disposal site as in the embodiment described above.

While my invention has been described in terms of a number of specific illustrative embodiments, it is not so limited as many variations thereof will be apparent to persons skilled in the related art without departing from the true spirit and scope of my invention. It is my intention that my invention be limited only by the limitations imposed in the claims appended hereinafter below.

I claim:

1. A method for recovering hydrocarbons from oil shale comprising mineral rock and kerogen materials comprising (a) grinding the oil shale to a predetermined fineness;

(b) exposing the oil shale material to an oxidative environment comprising a free oxygen containing gas at a predetermined temperature for sufficient time to cause oxidative scission of a portion of the kerogen which produces organic fragments removed from the kerogen, said oxidative environment also including a liquid solvent for the organic fragments;

(c) separating the solvent and organic fragments from the residual solids; and (d) separating the organic fragments from the solvent.

2. A method as recited in claim 1 wherein the temperature of the oxidative environment is from 80° to 150° F.

3. A method as recited in claim 2 wherein the temperature is from 90° to 110° F.

4. A method as recited in claim 1 wherein the solvent is selected from the group consisting of naphthalene, tetralin phenanthracene and mixtures thereof.

5. A method as recited in claim 4 wherein the solvent is naphthalene.

6. A method as recited in claim 4 wherein the solvent is tetralin.

7. A method as recited in claim 4 wherein the solvent is phenanthracene.

8. A method as recited in claim 1 wherein the solvent is saturated with the free oxygen-containing gas.

9. A method as recited in claim 1 wherein the oil shale material is exposed to the free oxygen-containing gas for a period of from 1 to 6 hours.

10. A method as recited in claim 9 wherein the time of exposure is from 2 to 4 hours.

11. A method as recited in claim 1 wherein the oxidative environment also includes an acid.

12. A method as recited in claim 1 wherein sufficient weak acid is added to reduce the pH of the oxidative environment to a value in the range of from 4 to 7.

13. A method as recited in claim 12 wherein the acid is selected from the group consisting of acetic acid, phosphoric acid, sulfurous acid, sulfamic acid and mixtures thereof.

14. A method as recited in claim 1 wherein the oxidative environment also contains a mixture of potassium iodide and iodine.

15. A method as recited in claim 14 wherein the amount of the mixture of potassium iodide and iodine is from 0.25 to 1.0% by weight.

16. A method as recited in claim 14 wherein the molar ratio of the mixture of potassium iodide and iodine added to the oxidative environment is from 1/400 to 1/100.

17. A method as recited in claim 1 wherein an effective amount of an inorganic phosphate is added to the oxidative environment.

18. A method as recited in claim 17 wherein the inorganic phosphate is sodium phosphate.

19. A method as recited in claim 17 wherein the concentration of phosphate added to the oxidative environment is from 1 to 7% by weight.

20. A method is recited in claim 1 comprising the additional step of exposing the residual solids from the oxidative scission reaction to a temperature in the range from 550° to 800° F. for a period of 0.1 to 2 hours, and recovering components pyrolyzed and/or vaporized from the residual solids as a result of the high temperature bake-off.

21. A method as recited in claim 20 wherein the temperature is from 600° to 750° F.

22. A method as recited in claim 20 wherein the time that the solids are exposed to the elevated temperatures is from $\frac{1}{4}$ to $1\frac{1}{2}$ hours.

23. A method as recited in claim 20 wherein the time is from $\frac{1}{4}$ to 1 hour.

* * * * *